US010078291B2

(12) United States Patent
Shinkawa et al.

(10) Patent No.: US 10,078,291 B2
(45) Date of Patent: Sep. 18, 2018

(54) DEVELOPING APPARATUS HAVING A PROJECTING REGULATING MEMBER AND PROCESS CARTRIDGE

(71) Applicant: CANON KABUSHIKI KAISHA, Tokyo (JP)

(72) Inventors: Takaaki Shinkawa, Yokohama (JP); Kazuhiro Okubo, Kawasaki (JP); Jun Miura, Kawasaki (JP); Yoshinobu Ogawa, Numazu (JP); Ryo Sugiyama, Mishima (JP); Mitsuru Okuda, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/658,621

(22) Filed: Jul. 25, 2017

(65) Prior Publication Data

US 2018/0032000 A1 Feb. 1, 2018

(30) Foreign Application Priority Data

Jul. 29, 2016 (JP) ..... 2016-150121
Oct. 5, 2016 (JP) ..... 2016-197323

(51) Int. Cl.
*G03G 15/08* (2006.01)

(52) U.S. Cl.
CPC ..... *G03G 15/0812* (2013.01)

(58) Field of Classification Search
CPC ..... G03G 15/0812
(Continued)

(56) References Cited

U.S. PATENT DOCUMENTS 5,338,895 A 8/1994 Ikegawa et al.
5,587,551 A 12/1996 Ikegawa et al.
(Continued)

FOREIGN PATENT DOCUMENTS

EP 2418547 A1 2/2012
JP 62105170 A * 5/1987
(Continued)

OTHER PUBLICATIONS

Yoshinobu Ogawa et al., U.S. Appl. No. 15/658,607, filed Jul. 25, 2017.

(Continued)

*Primary Examiner* — Billy Lactaoen
(74) *Attorney, Agent, or Firm* — Fitzpatrick, Cella, Harper & Scinto

(57) ABSTRACT

A developing apparatus includes a developer carrying member, a developing frame member to rotatably supporting the developer carrying member, and a regulating member provided on the developing frame member and regulating developer carried on the developer carrying member. The regulating member includes a projecting part projected towards the developer carrying member and having an abutting part that abuts the developer carrying member, and an opposing surface facing the developer carrying member. The opposing surface is positioned on an upstream side of the projecting part and arranged to connect the projecting part with a distal end of the regulating member at a free end side of the regulating member. In addition, the opposing surface is a surface having no point of reverse curve, and the distance between the opposing surface and the developer carrying member is constant or decreasing with distance from the projecting part.

8 Claims, 8 Drawing Sheets

(58) Field of Classification Search
USPC ..... 399/274, 260
See application file for complete search history.

(56) References Cited

U.S. PATENT DOCUMENTS

| | | | | |
|---|---|---|---|---|
| 6,148,167 | A | 11/2000 | Komakine et al. | |
| 2005/0185974 | A1* | 8/2005 | Terai | G03G 15/095 399/30 |
| 2012/0039638 | A1* | 2/2012 | Park | G03G 15/0812 399/274 |
| 2015/0043952 | A1 | 2/2015 | Kitan | |
| 2017/0285526 | A1 | 10/2017 | Seki et al. | |

FOREIGN PATENT DOCUMENTS

| | | | |
|---|---|---|---|
| JP | H03-48876 | A | 3/1991 |
| JP | H07-044018 | A | 2/1995 |
| JP | 2006-251730 | A | 9/2006 |
| JP | 2010-230998 | A | 10/2010 |
| JP | 2013-061366 | A | 4/2013 |

OTHER PUBLICATIONS

Mitsuru Okuda et al., U.S. Appl. No. 15/649,706, filed Jul. 14, 2017.
Jan. 29, 2018 Great Britain Search and Examination Report in co-pending British Patent Application No. 1712038.7.

* cited by examiner

DEVELOPING APPARATUS HAVING A PROJECTING REGULATING MEMBER AND PROCESS CARTRIDGE

BACKGROUND OF THE INVENTION

Field of the Invention

The present invention relates to developing apparatuses and process cartridges included in image forming apparatuses used in electrophotographic printers and electrophotographic copiers which form images on recording materials.

Description of the Related Art

It is known that in some image forming apparatuses, a developing apparatus including a developing unit such as a developer carrying member (developing roller) or a process cartridge including the developing apparatus and an image bearing member (photosensitive member drum) is configured to be detachably attachable to the image forming apparatus, facilitating the maintenance of the apparatus. Such image forming apparatuses use an electrophotographic image forming process in which a toner is applied to the surface of the developer carrying member (developing roller), and is formed into a toner layer having a uniform thickness using a regulating member. An electrostatic latent image formed on the image bearing member is then developed with the toner on the developer carrying member to be visualized as a toner image. The toner image is then transferred onto a recording material, and is fixed onto the recording material by a fixing unit to form an image.

In a conventional configuration, the regulating member and the developer carrying member form a line contact, that is, have an extremely short contact width extending in the rotational direction of the developer carrying member. Such a line contact results in poor charging properties of the toner by the regulating member. Moreover, if the toner adheres to the portion of the regulating member contacting the developer carrying member, such a line contact causes poor regulation of the toner by the regulating member, resulting in an uneven toner layer.

Japanese Patent Application Laid-Open No. H03-48876 discloses a regulating member which supports one end of a developer carrying member located downstream of the rotational direction thereof, and contacts the other end of the developer carrying member with the outer peripheral surface of the developer carrying member to regulate a developer on the circumferential surface of a rotary body. In this configuration, the regulating member is bent externally to the developer carrying member near the contact portion between the regulating member and the developer carrying member, and the contact width of the developer carrying member in the rotational direction thereof is increased to provide a surface contact between the regulating member and the developer carrying member. Such a configuration can provide a uniform contact between the regulating member and the developer carrying member, solving the problems of the poor charging properties of the toner and adhesion of the toner.

In the configuration, the regulating member is bent externally to the developer carrying member near the contact portion between the regulating member and the developer carrying member. Thereby, the free end of the regulating member contacts the developer carrying member while the free end of the regulating member is closer to the developer carrying member from the upstream side of the rotational direction of the developer carrying member to the downstream side thereof. In other words, the upstream side of the rotational direction of the developer carrying member has a wedge-shaped space formed between the regulating member and the outer peripheral surface of the developer carrying member to have a width reduced from the upstream opening to the contact portion. The present inventors, who have conducted extensive research about this configuration, have found that the toner entering the wedge-shaped space may apply a deformation force to the regulating member in the direction of the regulating member shifting away from the outer peripheral surface of the developer carrying member to reduce the abutting pressure of the regulating member to the developer carrying member, and thus the abutment width. Accordingly, the present invention is directed to providing a configuration of a developing apparatus which can reduce poor regulation of a toner layer to reduce the generation of image defects.

SUMMARY OF THE INVENTION

According to one aspect of the present invention, there is provided the developing apparatus comprising a developer carrying member which carries a developer on the surface thereof, a developing frame member which rotatably supports the developer carrying member, and accommodates the developer, and a regulating member fixed to the developing frame member to regulate the developer carried on the developer carrying member. The regulating member has a projecting part, having an abutting part arranged to abut the developer carrying member, and an opposing surface, arranged to face the developer carrying member connected to the projecting part and including an end disposed as a free end, positioned on the downstream side in the rotational direction of the developer carrying member from the projecting part, and the opposing surface being a surface having no point of reverse curve in which the distance between the opposing surface and the developer carrying member is constant or decreases with distance from the projecting part.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments of the present invention will now be described in detail with reference to the drawings. It should be noted that dimensions, materials, shapes and relative arrangements of components described in the following embodiments, and values of parameters should be appropriately varied according to the configuration of the apparatus to which the present invention is applied, and a variety of conditions, and the scope of the present invention is not intended to be limited to the following embodiments.

Figure 5:
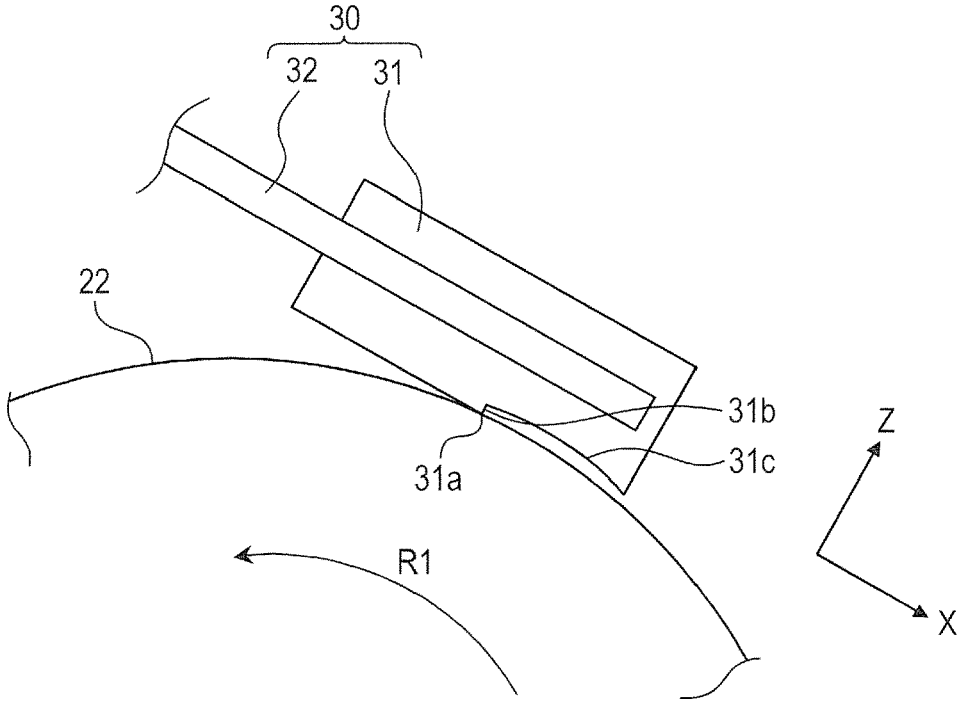
FIG. 5 is a schematic cross-sectional view illustrating one example of the developing blade according to the present invention.

In the developing apparatus according to the present invention, the term "width of a non-contacting gap" refers to a distance on a straight line from the center of the developing roller in the radius direction thereof. In other words, it means a distance from the surface of the developing roller to the surface of the projecting part facing the developing roller. The term "abutting part" refers to a portion in which a developer layer thickness controlling portion abuts on the surface of the developing roller. A portion at which the developer layer thickness controlling portion first abuts on the rotating developing roller is referred to as the "upstream edge" of the abutting portion. A portion in which the abutment of the developer layer thickness controlling portion and the developing roller ends is referred to as the "downstream edge" of the abutting portion. A portion further upstream of the upstream edge of the abutting portion is referred to as "upstream of the abutting portion." The term "longitudinal direction" refers to a direction parallel to the rotational axis of the developing roller. In FIG. 5, the term "longitudinal direction" refers to a direction perpendicular to the paper. The term "lateral direction" refers to the X-direction in FIG. 5, and the term "thickness direction" refers to the Z-direction in FIG. 5.

Embodiments

<Schematic Entire Configuration of Image Forming Apparatus>

Figure 2:
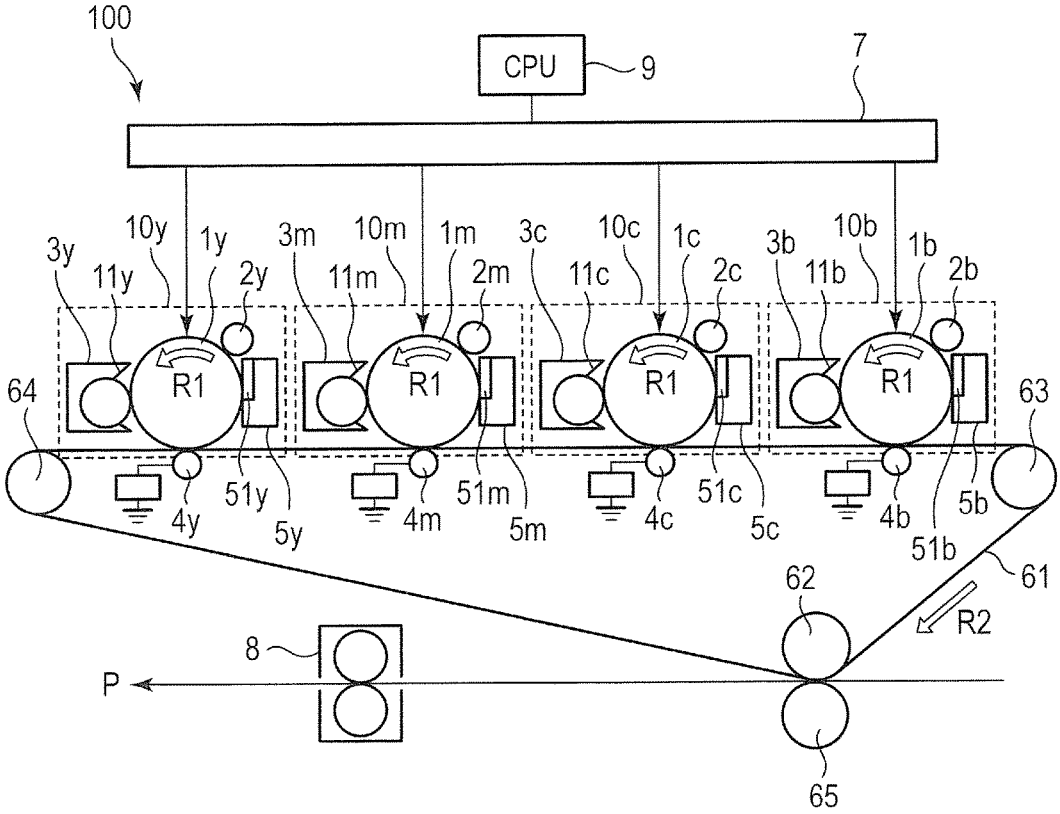
FIG. 2 is a cross-sectional view of an image forming apparatus including the developing blade according to an embodiment of the present invention.

The entire configuration of the electrophotographic image forming apparatus (hereinafter, referred to as image forming apparatus) according to the present invention will be first described. FIG. 2 is a schematic cross-sectional view illustrating an image forming apparatus 100 according to the present embodiment. The image forming apparatus 100 according to the present embodiment is a full-color laser printer using an in-line intermediate transfer method.

The image forming apparatus 100 can form full-color images on recording materials (such as recording paper, plastic sheets and cloths) according to image information. The image information is input to the image forming apparatus 100 from an image reading apparatus or a host apparatus (such as a personal computer) connected to the image forming apparatus 100 to enable communication with the image forming apparatus 100.

The image forming apparatus 100 includes a plurality of image forming units, i.e., first, second, third and fourth process cartridges 10*y*, 10*m*, 10*c* and 10*b* for forming images of yellow (y), magenta (m), cyan (c) and black (b), respectively. In the present embodiment, the first to fourth process cartridges 10*y*, 10*m*, 10*c* and 10*b* are disposed in a row in the direction intersecting the vertical direction.

In the present embodiment, the configurations and operations of the first to fourth process cartridges 10*y*, 10*m*, 10*c* and 10*b* are substantially the same except that the colors of the images to be formed are different. Accordingly, unless there is a need to distinguish the individual process cartridges, these process cartridges will be hereinafter collectively described without using the suffixes y, m, c and b attached to the reference number in order to indicate the colors for which the cartridges are provided.

In the present embodiment, as a plurality of image bearing members, the image forming apparatus 100 includes four drum-shaped electrophotographic photosensitive members, that is, photosensitive member drums 1 (1*y*, 1*m*, 1*c* and 1*b*) aligned in the direction intersecting the vertical direction. Each of the photosensitive member drums 1 is driven to be rotated by a driving unit (driving source, not illustrated). Charging rollers 2 (2*y*, 2*m*, 2*c* and 2*b*), a scanner unit (exposure apparatus) 7, developing units (developing apparatuses) 3 (3*y*, 3*m*, 3*c* and 3*b*)) and cleaning members 5 (5*y*, 5*m*, 5*c* and 5*b*) are disposed around the photosensitive member drums 1. The charging roller 2 is a charging unit which uniformly charges the surface of the photosensitive member drum 1. The scanner unit 7 is an exposing unit which forms an electrostatic image (electrostatic latent image) on the photosensitive member drum 1 through irradiation of the photosensitive member drum 1 with laser beams based on an output calculated by a CPU 9 from the image information input from the host apparatus such as a personal computer. The developing unit 5 develops the electrostatic image as a developer (hereinafter, referred to as toner) image. The cleaning member 3 is a cleaning unit which removes the residual toner (transfer residual toner) on the surface of the photosensitive member drum 1 after transfer.

The photosensitive member drum 1, and the charging roller 2, the developing unit 3 and the cleaning member 5 which act on the photosensitive member drum 1 are integrated into one process unit to form a process cartridge 10. The process cartridge 10 is detachably attachable to the image forming apparatus 100 through a mount unit disposed in the image forming apparatus 100, such as a mount guide and a positioning member.

An intermediate transfer belt 61 is disposed facing the four photosensitive member drums 1 as an intermediate transfer body for transferring the toner images on the photosensitive member drums 1 onto a recording material P. The intermediate transfer belt 61 in the form of an endless belt abuts on all of the photosensitive member drums 1 to circulate (rotate) in the arrow direction R2 (in the clockwise direction) illustrated in the drawing. The intermediate transfer belt 61 is wound around a plurality of supporting members, i.e., a secondary transfer opposite roller 62, a driving roller 63 and a following roller 64.

Four primary transfer rollers 4 (4*y*, 4*m*, 4*c* and 4*b*) as primary transfer units are aligned on the inner peripheral surface of the intermediate transfer belt 5 so as to face the respective photosensitive member drums 1. The primary transfer roller 4 presses the intermediate transfer belt 61 against the photosensitive member drum 1 to form a primary transfer portion in which the intermediate transfer belt 61 abuts on the photosensitive member drum 1.

As a secondary transfer unit, a secondary transfer roller 65 is disposed in a position facing the secondary transfer opposite roller 62 on the outer peripheral surface of the intermediate transfer belt 61. The secondary transfer roller 65 is pressed against the secondary transfer opposite roller 62 with the intermediate transfer belt 65 interposed therebetween to form a secondary transfer portion in which the intermediate transfer belt 61 abuts on the secondary transfer roller 65.

The recording material P having the toner image transferred thereonto is transported to a fixing apparatus 8 as a fixing unit. Heat and pressure are applied to the recording material P in the fixing apparatus 8 to fix the toner image onto the recording material P.

The image forming apparatus 100 can also form a monochromatic or multi-color image using only one image forming unit or some (but not all) of the image forming units as desired.

<Image Forming Process>

During image formation, the surface of the photosensitive member drum 1 is first charged uniformly by the charging roller 2. Next, the charged surface of the photosensitive member drum 1 is scanned and exposed with laser light emitted from the scanner unit 7 based on the output calculated from the image information input from the host apparatus by the CPU 9, forming an electrostatic image on the photosensitive member drum 1 according to the image information. Next, the electrostatic image formed on the photosensitive member drum 1 is developed as a toner image by the developing unit 3. A voltage having a polarity opposite to the charging polarity of the toner is then applied to the primary transfer roller 4 from a primary transfer voltage power supply (high-voltage power supply) as a primary transfer voltage applying unit. The toner image on the photosensitive member drum 1 is thereby primarily transferred onto the intermediate transfer belt 61. During formation of a full-color image, the process is sequentially performed on the first to fourth process cartridges 10*y*, 10*m*, 10*c* and 10*b* to primary transfer the layered toner images of the respective colors onto the intermediate transfer belt 61.

Subsequently, the recording material P is transported to the secondary transfer portion in synchronization with the movement of the intermediate transfer belt 61. A voltage having a polarity opposite to the charging polarity of the toner is applied to the secondary transfer roller 65 from a secondary transfer voltage power supply (high-voltage power supply) as a secondary transfer voltage applying unit (not illustrated). The toner images of four colors on the intermediate transfer belt 61 are thereby secondarily transferred collectively onto the recording material P transported by the sheet feeding unit by the action of the secondary transfer roller 65 abutting on the intermediate transfer belt 61 with the recording material P interposed therebetween.

The recording material P having the toner image transferred thereonto is transported to the fixing apparatus 8 as a fixing unit. In the fixing apparatus 8, heat and pressure are applied to the recording material P to fix the transferred toner image, and the recording material P is discharged from the image forming apparatus 100.

The primary transfer residual toner remaining on the photosensitive member drum 1 after the primary transfer step is removed by a cleaning member 51 to be recovered.

The developing unit 3 performs reversal development in the state where the developing roller (described later) as a developer carrying member contacts the photosensitive member drum 1. Namely, in the developing unit 4 used, the toner charged to have the same polarity as the charging polarity of the photosensitive member drum 1 (negative polarity in the present embodiment) is applied to a portion (image portion, exposed portion) of the photosensitive member drum 1 whose charge is decayed as a result of exposure, thereby developing the electrostatic image.

<Configuration of Process Cartridge>

The entire configuration of the process cartridge 10 to be mounted on the image forming apparatus 100 according to the present embodiment will now be described. The process cartridges 10 of the four colors have the same shape except for an identification portion (not illustrated), and the developing units 4 of the process cartridges 10 each accommodate toners of yellow (y), magenta (m), cyan (c) and black (b). The developing unit 3 used a non-magnetic one-component toner as a developer.

Description will now be made with reference to FIG. 2 illustrating a cross-section of the photosensitive member drum 1 taken in a direction intersecting the longitudinal direction (rotational axis line direction). The process cartridge 10 is configured to integrate a photosensitive member unit including the photosensitive member drum 1 and the developing unit (developing apparatus) 3 including a rotatable developing roller 11 into one.

The photosensitive member unit includes the photosensitive member drum 1, and the cleaning unit (cleaning apparatus) 5, in which a cleaning blade 51 and the charging roller 2 are disposed in a cleaning frame so as to contact the circumferential surface of the photosensitive member drum 1. The photosensitive member drum 1 is rotatably supported by bearings (not illustrated) with respect to the cleaning unit 5. Through transmission of the driving force of the driving unit (driving source, not illustrated) to the photosensitive member unit, the photosensitive member drum 1 is driven to be rotated in the direction of the arrow R1 illustrated in the drawing (counterclockwise direction) according to the image forming operation. The cleaning unit 5 is configured such that the transfer residual toner removed from the surface of the photosensitive member drum 1 by the cleaning blade 51 falls into the cleaning frame to be accommodated therein. The cleaning unit 5 is also configured such that the roller portion of the conductive rubber of the charging roller 2 is brought into press contact with the photosensitive member drum 1 to rotate following the photosensitive member drum 1.

Figure 3:
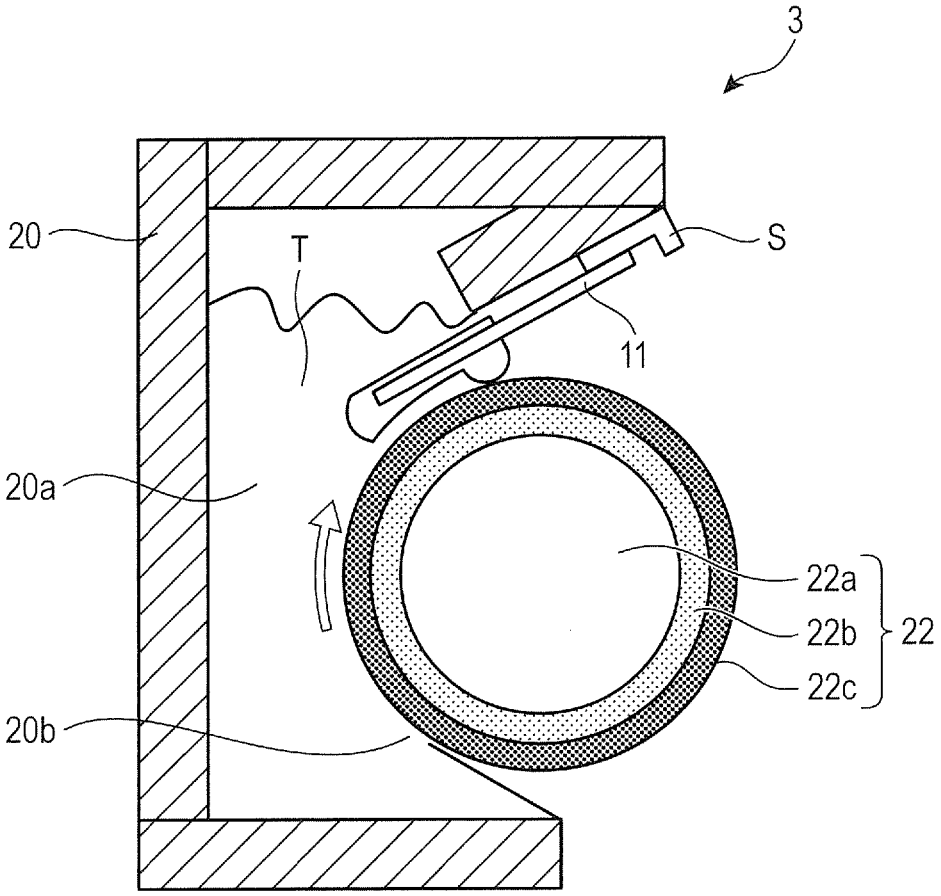
FIG. 3 is a cross-sectional view illustrating the developing unit according to an embodiment of the present invention.

As illustrated in FIG. 3, the developing unit 3 includes a developing roller 22 which carries a toner T, the developing blade (regulating member 11), and a developing frame member 20 which fixes the developing roller 22 and the developing blade 11. The developing frame member 20 includes a developing chamber 20*a* including the developing roller 22 disposed therein, and a developing opening (opening portion) 20*b* ranging from the developing chamber 20*a* to the outside. One end of a developing blade is fixed to the developing opening 20*b*, and the other end of the developing blade abuts on the developing roller 22, enabling regulation of the amount of the toner to be applied onto the developing roller 22 and frictional charging (tribomatic charging) of the toner T. The developing roller 22 is disposed in the developing opening 20*b* to enable abutment with the photosensitive member drum 1. The developing roller 22 includes, for example, a laminate of a substrate 22*a*, an electrically conductive elastic layer 22*b* and a surface layer 22*c* in sequence, and is disposed so as to be driven to be rotated in the arrow direction in the drawing.

[Developing Roller]

Figure 11:
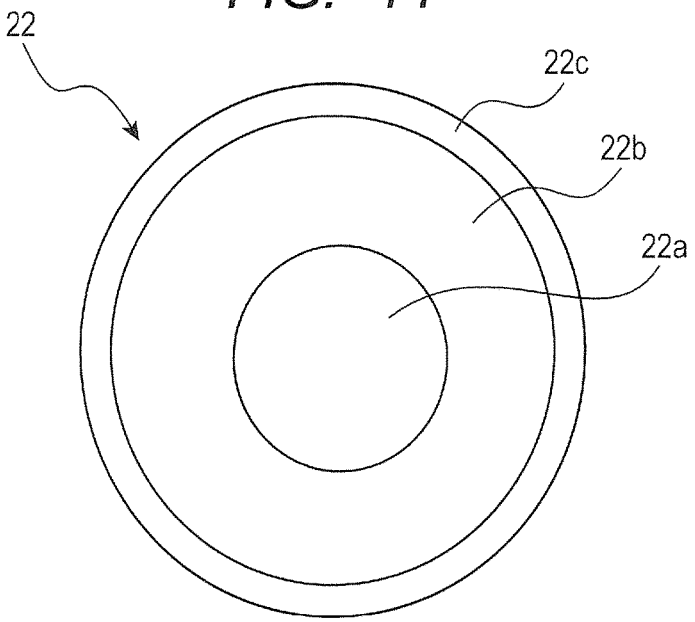
FIG. 11 is a schematic cross-sectional view illustrating one example of the developing roller according to the present invention.

As illustrated in FIG. 11, the developing roller according to the present invention includes a laminate including a cylindrical or hollow cylindrical conductive substrate 22*a*, a conductive elastic layer 22*b* formed on the outer peripheral surface of the substrate, and a surface layer 22*c* disposed on the outer peripheral surface of the conductive elastic layer, for example. The developing roller can have any other configuration, and a known developing roller can be used.

<Substrate>

The substrate included in the developing roller has conductivity, and supports a conductive elastic layer disposed thereon. Examples of the materials for the substrate include metals, such as iron, copper, aluminum and nickel; and alloys containing these metals, such as stainless steel, duralumin, brass and bronze. To give scratch resistance, the surface of the substrate may be plated in the range not impairing the conductivity. Furthermore, resin substrates having conductive surfaces coated with metals, and those prepared from conductive resin compositions can also be used.

<Conductive Elastic Layer>

The conductive elastic layer is disposed to provide a developing roller having the elasticity required for the apparatus including the developing roller. The conductive elastic layer specifically may have either a solid body or a foamed body. The conductive elastic layer may include a single layer or a plurality of layers. The developing roller is always pressed against the photosensitive drum and the toner under pressure. To reduce damage of these members mutually given, a conductive elastic layer having low hardness and low compression set is disposed, for example.

Examples of the materials for the conductive elastic layer include natural rubber, isoprene rubber, styrene rubber, butyl rubber, butadiene rubber, fluorocarbon rubber, urethane rubber and silicone rubber. These may be used singly or in combinations of two or more.

The conductive elastic layer may contain conductive agents, non-conductive fillers, and a variety of additive components needed for molding such as crosslinking agents, catalysts and dispersion promoters according to the functions required for the developing roller.

Examples of the conductive agents compounded in the conductive elastic layer include a variety of conductive metals or alloys, conductive metal oxides, fine particles of insulation substances coated with these conductive metal materials, electrically conductive agents such as carbon black, and ionically conductive agents. These conductive agents may be used singly or in combinations of two or more in the form of powder or fibers. Among these conductive agents, an electrically conductive agent carbon black can be used because of its high controllability of the conductivity and low cost. Such a conductive agent can be contained to control the volume resistivity of the conductive elastic layer to be $1\times10^4$ to $1\times10^{10}$ Ω·cm. A developing roller including a conductive elastic layer having a volume resistivity in this range facilitates the control of the amount of the toner to be developed on the photosensitive drum. The conductive elastic layer has a volume resistivity of more preferably $1\times10^4$ to $1\times10^9$ Ω·cm.

Examples of the non-conductive fillers optionally contained in the conductive elastic layer include: diatomite, quartz powder, dry silica, wet silica, titanium oxide, zinc oxide, aluminosilicic acid, calcium carbonate, zirconium silicate, aluminum silicate, talc, alumina and iron oxide.

The conductive elastic layer gives the elasticity required for the developing roller. The conductive elastic layer can have an asker C hardness of 10 degrees or more and 80 degrees or less, for example. A conductive elastic layer having an asker C hardness of 10 degrees or more can reduce the compression set caused by each member disposed facing the developing roller. A conductive elastic layer having an asker C hardness of 80 degrees or less can decrease the stress applied to the toner, and can suppress a reduction in image quality caused by repeated formation of images. Herein, the asker C hardness can be specified by the value measured by an asker rubber durometer (manufactured by Kobunshi Keiki Co., Ltd.).

The conductive elastic layer has a thickness of 0.1 mm or more and 50 mm or less, for example. The thickness is more preferably 0.5 mm or more and 10 mm or less.

Examples of the method of molding the conductive elastic layer include a variety of molding methods such as extrusion molding, press molding, injection molding, liquid injection molding and mold injection molding in which the material is cured by heating at an appropriate temperature for an appropriate time to mold a conductive elastic layer over a substrate. In mold injection molding, an uncured material for a conductive elastic layer is injected into a cylindrical metal mold in which a substrate is disposed, and is cured by heating. Such a method enables the molding of the conductive elastic layer around the substrate with precision.

<Surface Layer>

The developing roller may have a layer such as a surface layer on the outer periphery of the conductive elastic layer to have properties needed for the developing roller which transports or charges the toner. The surface layer can be a resin layer to satisfy these properties. Examples of the resin forming the surface layer include fluorinated resins, polyamide resins, melamine resins, silicone resins, urethane resins and mixtures thereof.

The surface layer in use may contain a resin and carbon black, which gives conductivity and reinforcing properties to the surface layer. The amount of carbon black to be compounded can be 3% by mass or more and 30% by mass or less relative to the resin component. The surface layer can be formed as follows: the resin is mixed with carbon black and a solvent, and is dispersed to prepare a coating solution, and the coating solution is applied onto a conductive elastic layer. Any solvent which can dissolve the resin to be used for the surface layer can be used for the coating solution.

The surface layer can have a thickness of 4 μm or more and 50 μm or less. A surface layer having a thickness of 4 μm or more can reduce wear during use. A surface layer having a thickness of 50 μm or less can decrease the stress applied to the toner caused by the surface hardness of the developing roller.

The surface layer can have any surface roughness. The surface roughness of the surface layer can be appropriately adjusted in use to ensure the force to transport the toner and thus obtain images of high quality. An effective method of controlling the surface roughness is that a particle having a desired particle size is contained in the surface layer. The particle used in the surface layer may be a metal particle and a resin particle having a particle size of 0.1 mm or more and 30.0 mm or less. Among these particles, a resin particle is more preferred because of its high flexibility, relatively low specific gravity, and the readily attainable stability of the coating material. If the surface layer includes multiple sublayers, such a particle may be contained in all of the multiple sublayers, or may be contained in at least one layer of these sublayers.

In the present embodiment, the developing roller 22 and the photosensitive member drum 1 are rotated such that in the facing portion, the surfaces of the developing roller 22 and the photosensitive member drum 1 move in the same direction (from the upward direction to the downward direction of the gravity direction in the present embodiment). A predetermined DC voltage is applied to the developing roller 22, and an electrostatic latent image is visualized with the toner negatively charged by frictional charging in the developing portion where the developing roller contacts the photosensitive member drum 1. A toner image is thereby formed. While the developing roller 22 is disposed in contact with the photosensitive member drum 1 in the present embodiment, the developing roller 22 may be spaced from the photosensitive member drum 1 with a predetermined interval to be disposed close to the photosensitive member drum 1.

<Configuration of Developing Blade>

The configuration of the developing blade according to the present embodiment will be described in detail with reference to FIGS. 1A and 1B. The developing blade 30 abuts on the developing roller 22 so as to be directed in the counter direction, performing regulation of the amount of the toner to be applied and charging of the toner. In the present embodiment, the developing blade 30 used is a support part 32 formed of a SUS plate in the form of a plate spring and having a thickness of 50 to 120 mm. The surface of a blade part 31 is brought into abutment with the developing roller 22 utilizing the spring elasticity of the support part 32. The developing blade 30 has the blade part 31 formed on one end thereof in the lateral direction, and the other end of the developing blade 30 is connected to a supporting member S fixed to the developing frame member 20 to be supported.

The support part and the blade part may be formed of a single material, or may be formed of different materials. Any support part can be used in the developing blade as long as the support part can support the blade part. In the present invention, the support part and the blade part can have any configuration other than the configuration in which these parts are present as individually independent members as described above; these parts may be integrated to be present as the support and blade portion of the developing blade.

[Blade Part]

Examples of the material for the blade part include, but should not be limited to, elastic materials such as rubber and thermoplastic elastomers, and a variety of resins. Specific examples thereof include: rubbers having rubber elasticity such as thermosetting polyurethane rubber, silicone rubber and liquid rubber; thermoplastic resins such as polyester resins, polyamide resins and polyether resins; and thermoplastic elastomers such as polyester elastomers, polyurethane elastomers and polyamide elastomers.

If the material for the blade part is different from the material for the support part, the following materials can be used for the blade part: thermosetting resins or rubbers such as silicone resins, silicone rubbers, urethane resins, urethane rubbers, phenol resins, urea resins, melamine resins, acrylic resins and epoxy resins; and thermoplastic resins such as acrylic resins, polyethylene resins, polyamide resins, polyester resins and polyether resins. Among these materials, the thermoplastic resins can be used in molding of the blade parts because these resins can be readily deformed into a desired shape by heating.

If the support part and the blade part are formed of different materials, the blade part can have any thickness (distance in the Z-direction in FIG. 5). The blade part in the developer layer thickness controlling portion can have a thickness of 10 μm or more and 3 mm or less. A blade part having a thickness of 10 μm or more in the developer layer thickness controlling portion can ensure the durability against wear caused by the friction with the developing roller while maintaining the elasticity as a resin or rubber. A blade part having a thickness of 3 mm or less in the developer layer thickness controlling portion can provide stable abutting pressure to the developing roller.

The blade part can be formed in any place with respect to the support part. The blade part can be formed on one surface of the support part abutting on the developing roller, or may be formed so as to cover both surfaces of the support part. For example, as illustrated in FIG. 5, a blade part having a developer regulating portion and a projecting part can be formed on one end of the support part, and the support part extends to the position of the projecting part.

The blade part can be formed by metal mold molding, extrusion molding, coating molding, sheet bonding molding or injection molding. Specifically, a blade part can be molded in metal mold molding or extrusion molding as follows: A support part, to which an adhesive is applied when necessary, is placed in a molding metal mold, a resin material melted by heating is injected into the molding metal mold to mold a blade part joined to the support part. In sheet bonding molding, a blade part molded into a sheet by extrusion molding can be bonded to a support part to which an adhesive is applied. In injection molding, the resin material can be injected into a metal mold cavity, and be cooled to mold a blade part.

An adhesive layer can be formed on the support part when necessary in the formation of the blade part. Examples of the material for the adhesive layer include hot-melt adhesives such as polyurethane, polyester, ethylene vinyl alcohol (EVA) and polyamide adhesives.

[Support Part]

Examples of the material for the support part include, but should not be limited to, SUS, metals such as surface treated steel sheets such as steel sheets subjected to chromate conversion coating, stainless steel, phosphor bronze and aluminum; and resins such as acrylic resins, polyethylene resins and polyester resins. If these resins require conductivity in use, an electrically conductive material can be added to the resins.

The support part can have any thickness (distance in the Z-direction in FIG. 5). The thickness can be 0.05 mm or more and 3 mm or less. Particularly if the support part is a thin plate having a thickness of 0.05 mm or more and 0.15 mm or less, the support part has appropriate spring properties, which can bring the blade part into abutment with the developing roller under appropriate abutting pressure to regulate the toner on the developing roller into an appropriate thickness. A support part having a thickness of 0.8 mm or more can facilitate the mount and positioning of the developing blade on the developing apparatus, the process cartridge and the electrophotographic image forming apparatus without distortion. For this reason, the blade part can be brought into abutment stably with the developing roller under appropriate abutting pressure.

If the support part and the blade part are formed of a single metal material, the support part can be molded by a method such as bending (such as press), electrochemical cutting, electrical discharge cutting or laser beam cutting.

A support part formed of a thermoplastic resin can be molded by extrusion molding or injection molding, for example. Specifically, in extrusion molding, the thermoplastic resin melted by heating can be injected into a molding metal mold to mold a support part. In injection molding, the thermoplastic resin can be injected into a metal mold cavity, and be cooled to mold a support part.

[Conductive Agent]

The support part, the blade part and the adhesive layer may contain a conductive agent when necessary. Examples of the conductive agent include ionically conductive agents and electronically conductive agents such as carbon black.

Examples of carbon black specifically include conductive carbon black such as "Ketjenblack" (trade name, manufactured by Lion Corporation) and acetylene black; and carbon black for rubber such as SAF, ISAF, HAF, FEF, GPF, SRF, FT and MT. Besides, carbon black for color ink subjected to an oxidation treatment, and pyrolysis carbon black can be used. Carbon black can be used in an amount of 5 parts by mass or more and 50 parts by mass or less relative to 100 parts by mass of the resin or rubber. The content of carbon black in the resin or rubber can be measured with a thermogravimetric analyzer (TGA).

In addition to carbon black above, examples of usable electronically conductive agents include: graphites such as natural graphite and artificial graphites; powdery metals such as copper, nickel, iron and aluminum; powdery metal oxides such as titanium oxide, zinc oxide and tin oxide; and conductive polymers such as polyaniline, polypyrrole and polyacetylene. These conductive agents can be used singly or in combinations of two or more when necessary.

Examples of the ionically conductive agent include: perchlorates, chlorates, hydrochlorides, bromates, iodates, fluoroboric acid salts, trifluoromethylsulfates, sulfonates and bis(trifluoromethylsulfonic acid)imide salts containing ammonium ions such as tetraethylammonium, tetrabutylammonium, lauryltrimethylammonium, dodecyltrimethylammonium, stearyltrimethylammonium, octadecyltrimethylammonium, hexadecyltrimethylammonium, benzyltrimethylammonium and modified aliphatic dimethylethylammonium; perchlorates, chlorates, hydrochlorides, bromates, iodates, fluoroboric acid salts, trifluoromethyl sulfates, sulfonates and bis(trifluoromethylsulfonic acid)imide salts containing an alkali metal or an alkaline earth metal such as lithium, sodium, calcium or magnesium. Among these, trifluoromethyl sulfates and bis(trifluoromethyl sulfonic acid)imide salts of an alkali metal or ammonium ion can be used. These salts are suitable because these have a structure of an anion containing fluorine, and thus have a large effect of giving conductivity. These salts can be used singly or in combinations of two or more when necessary.

The support part, the blade part and the adhesive layer can contain other additives such as a charge control agent, a lubricant, a filler, an antioxidant and an anti-aging agent in the ranges not inhibiting the functions of the resin or rubber and the conductive agent.

In the present embodiment, the blade part 31 includes a projecting part 31*d* projecting toward the developing roller 22 to contact the developing roller 22, and an opposing surface 31*c*1 facing the developing roller 22 and having one end connected to the projecting part 31*d* and the other end disposed as a free end, in sequence from the downstream side of the rotational direction of the developing roller 22. The projecting part 31*d* has an abutting part (nip portion) N which contacts the developing roller 22.

In the abutting part (nip portion) N, the toner T is frictionally charged by friction with the developing roller 22 generated as a result of rotation of the developing roller 22; the thickness of the toner T on the developing roller 22 is regulated at the same time when the toner is charged, thereby providing a toner layer having a uniform thickness. In the present embodiment, the abutment width (nip width) W between the blade part 31 and the developing roller 22 is 600 to 800 μm when the blade part 31 abuts on the developing roller 22 under a force of 50 gf/cm. In the present embodiment, a predetermined voltage is applied to the developing blade 30 from a blade voltage power supply (not illustrated) to stabilize the coating of the toner.

Figure 10:
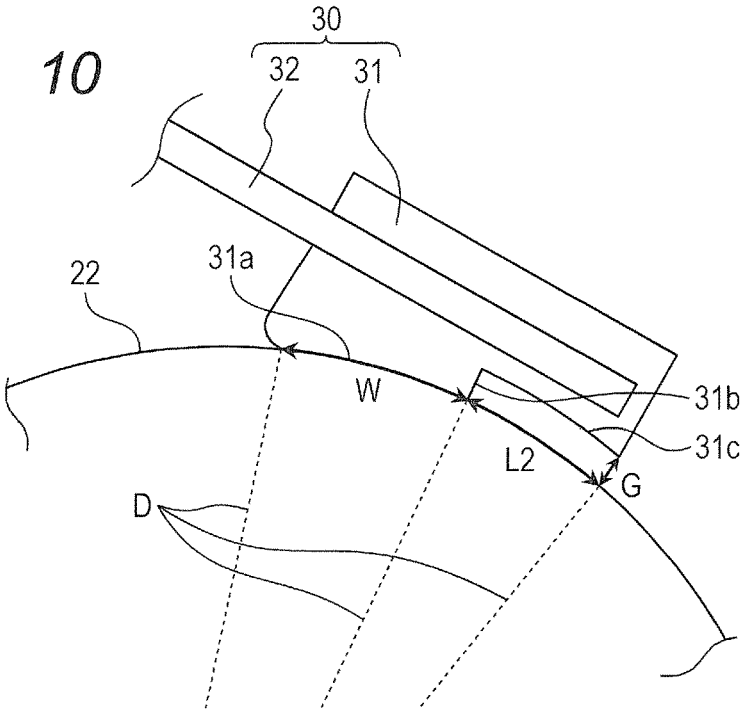
FIG. 10 is a schematic cross-sectional view illustrating the shape of the abutting part.

The blade part can have a length W of the developer layer thickness controlling portion in the rotational direction of the developing roller (distance of the arc in FIG. 10) of 1.0 mm or more and 5.0 mm or less where the developer layer thickness controlling portion is the abutting part with the developing roller. As illustrated in FIG. 10, a developer layer thickness controlling portion having a curved surface formed along the surface of the developing roller can ensure a long abutment width.

In the opposing surface 31*c*1, the rotation of the developing roller 22 results in feed of the toner between the developing roller 22 and the opposing surface 31*c*1, and a pressure F2 is applied in the normal direction of the opposing surface 31*c*1 from the toner.

In this configuration of the opposing surface 31*c*1, the distance to the developing roller 22 is identical or reduced from one end connected to the projecting part 31*d* to the other end disposed as a free end. Specifically, the opposing surface 31*c*1 has a curved surface having a curvature radius R with no point of reverse curve. Since the opposing surface 31*c*1 is a curved surface having no point of reverse curve, the pressure F2 from the toner, which is a force applied in the direction orthogonal to the plane extending in the lateral direction of the support part 32 to deform the developing blade 30, can be partially dispersed as a force applied in the lateral direction of the support part 32. This partial dispersion of the pressure F2 can disperse the force applied to the developing blade 30 from the toner, and prevent the deformation of the developing blade 30 generated by the developing blade 30 pushed up in the direction away from the developing roller 22. As a result, an appropriate abutting pressure can be applied between the developing blade 30 and the developing roller 22, providing a predetermined abutment width W.

The present inventors, who have conducted further research, haves found that a curvature radius R of the opposing surface 31*c*1 can be within the following range. Where the radius of the developing roller 22 is X (mm), the continuous curved surface forming the opposing surface 31*c*1 can have a curvature radius R represented by an expression $R=X\pm0.5X$ (mm). According to this knowledge, the curvature radius R can be controlled within the range of the lower limit where the developing roller 22 does not abut on the distal end of the developing blade 30 to a value at which the generation of the force contributing to the deformation of the developing blade 30 can be reduced while the amount of the toner to be fed between the opposing surface 31*c*1 and the developing roller 22 is appropriately controlled.

Such control of the curvature radius R can suppress a reduction in abutting pressure between the developing blade 30 and the developing roller 22, and reduce the adhesion of the toner in the contact portion between the developing blade and the developing roller 22. Thus, in the present embodiment, poor regulation of the toner by the developing blade 30 and generation of image defects can be reduced.

The toner particles of the toner T may have an uneven charge quantity in the related art. This is probably because the toner T contains mainly three types of toner particles. The toner particle of the first type is a toner particle T1 which contacts the developing roller 22 to be charged. That of the second type is a toner particle T2 which does not contact the developing roller 22 and is not charged at all, on the contrary. That of the third type is a toner particle T3 which does not contact the developing roller 22 but is indirectly charged from the toner particle T1 through contact with the toner particle T1 which contacts the developing roller 22 to be charged. As described above, the toner T contains the toner particles T1, T2 and T3 having different amounts of charges given by the developing roller 22. Such different amounts of charges of the toner particles may reduce the toner densities of image forming portions or may cause fogging or adhesion of the toner to non-image forming portions during developing of the electrostatic latent image on the photosensitive member drum 1 to generate image defects.

In the present embodiment, the distance of the straight line connecting both ends of the continuous curved surface forming the opposing surface 31*c*1, i.e., the length L of the opposing surface 31*c*1 to the level difference forming the projecting part 31*d* projecting from the free end (distal end) in the blade part 31 is controlled to be 0.85≤L1 (mm)≤2.00. The maximum height of the projecting part 31*c*1 from the connection portion between the opposing surface 31*c*1 and the projecting part 31*d* in the direction orthogonal to the plane extending in the lateral direction of the support part 32, that is, the height H of the projection of the projecting part 31*c*1 is controlled to be 0.1≤H (mm)≤0.3. In such a configuration, the toner particles T1, T2 and T3 can be better contacted with each other in the space defined between the developing roller 22 and the opposing surface 31*c*1; as a result, a uniform charge quantity (amount of charges) is given to the respective toner particles of the toner T, thus reducing the generation of image defects such as fogging.

In the present embodiment, additionally, in the region of the opposing surface 31*c*1 of the developing blade 30, the thickness in the normal direction of the developing roller 22 in the abutting part (nip portion) N is increased from one end connected to the projecting part 31*d* toward the other end disposed as a free end. Such a configuration of the developing blade can sufficiently ensure the abutment width W between the blade part 31 and the developing roller 22, and also keep predetermined positioning of the abutting part N independently of the abutting state, providing stable abutment of the blade part 31 with the developing roller 22.

Figure 1A:
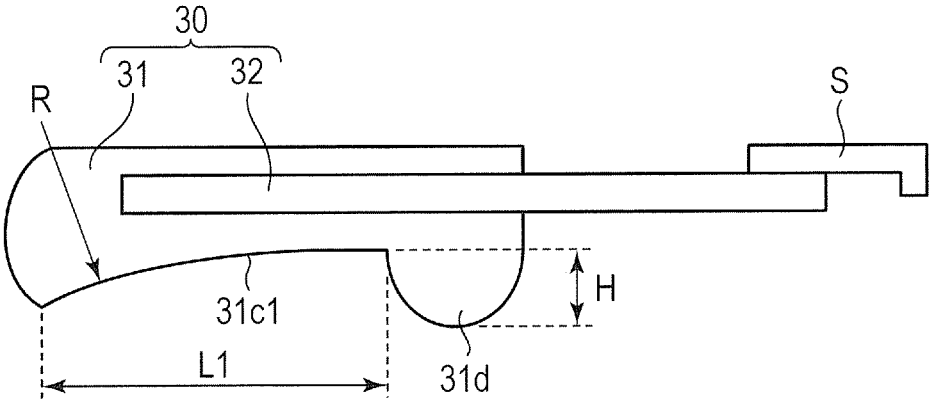
FIGS. 1A and 1B are diagrams illustrating the developing blade according to an embodiment of the present invention.
Figure 1B:
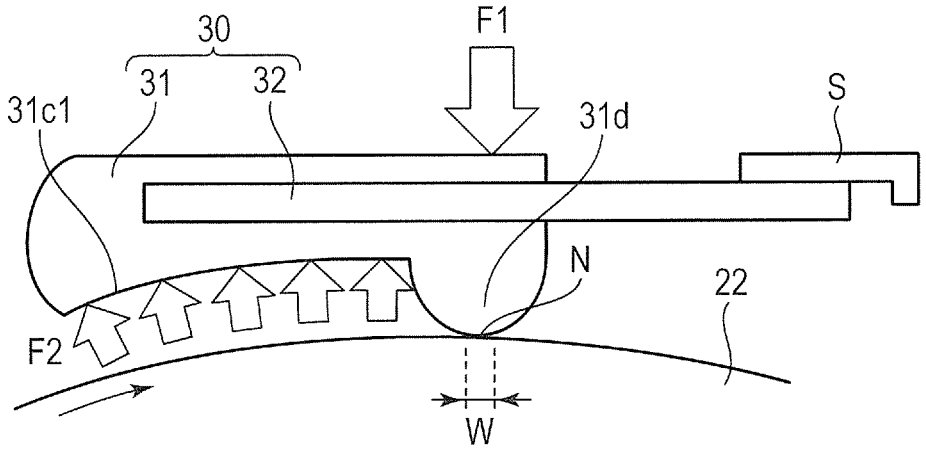

Although the developing blade illustrated in FIG. 5 has a shape different from that of the developing blade illustrated in FIGS. 1A and 1B, these developing blades both have the developer layer thickness controlling portion and the projecting part, in which the surface (opposing surface) of the projecting part facing the developing roller is inwardly curved. The blade part has the developer layer thickness controlling portion and the projecting part, and a projecting part 31*c* is disposed in the distal end direction of the blade part 31.

According to the developing apparatus according to this configuration, the toner transported by the developing roller and having an excessively high charge quantity after developing of a solid white image is removed from the surface of the developing roller in the "toner removing region" formed by the gap between the surface of the developing roller and the projecting part (opposing surface 31*c*1) of the developing blade. Furthermore, the toner removed from the developing roller and the toner fed from the developing chamber 20*a* are circulated together to provide a uniform charge quantity of the toner, reducing ghost images.

One of known image defects attributed to the difference in the amount of charges of the toner is ghost images (a phenomenon that the trace of the image previously formed appears on the image subsequently formed). The difference in the amount of charges of the toner regulated by the developing blade in the next image formation tends to be large in the region in which a solid white image having an image density of 0% is developed and in the region in which a solid black image having an image density of 100% is developed. The toner on the developing roller is barely developed in the region having a low image density, particularly in the region of the solid white image. For this reason, the toner will be subjected to repeated friction between the developing blade and the developer feed roller, being likely to result in a high amount of charges of the toner. The toner on the developing roller is mostly developed in the region having a high image density, particularly the region of the solid black image. As a result, the difference in amount of charges of the toner between the region of the solid black image and that of the solid white image is increased to generate the ghost image.

To avoid this problem, the developing blade is formed so as to satisfy the relationships represented by expressions (1), (2) and (3). In other words, a non-contacting gap is formed with respect to the surface of the developing roller upstream of the abutting part between the developer layer thickness controlling portion and the developing roller. The width of the gap is defined as G, and the maximum width and minimum width of the gap are defined as Gmax and Gmin, respectively, where the width G satisfies the relationships represented by expressions:

$$0.05\ \text{mm} \leq G \leq 0.5\ \text{mm} \quad (1)$$

$$G\text{max}/G\text{min} \leq 3.0. \quad (2)$$

The continuous length L2 of the surface of the developing roller in the rotational direction satisfies the relationship represented by expression (3) in the gap satisfying the relationships represented by expressions (1) and (2):

$$L2 \geq 0.8\ \text{mm}. \quad (3)$$

Such a configuration provides an effect of removing the toner on the developing roller and circulating the toner in the toner removing region. The toner removing region can be ensured to have a long and narrow gap in the toner transportation direction (rotational direction of the developing roller) into which the toner is tightly filled. In such a gap, the circulation of the toner occurs with the friction between the surface of the developing roller and the toner. As a result, the toner on the developing roller can have a uniform charging state, reducing the generation of ghost images caused by the difference in charging state of the toner on the developing roller.

In the developing apparatus according to the present invention, the width G of the gap in the projecting part is 0.05 mm or more and 0.5 mm or less. Because the toner is excessively tightly filled in a gap having a width G of less than 0.05 mm, the toner insufficiently circulates, leading to difficulties in giving a uniform charge quantity to the toner removed from the developing roller and the toner fed from the developing chamber 20*a*. Because the toner is not tightly filled in a gap having a width G of more than 0.5 mm in the projecting part, the toner receives insufficient friction. As a result, the toner having an excessively high charge quantity after developing of the solid white image cannot be removed from the surface of the developing roller. In a gap having a width G in the range of 0.05 mm or more and 0.3 mm or less, the removal of the toner from the surface of the developing roller and the circulation of the toner in the gap region of the projecting part are suitably performed.

In the developing apparatus according to the present invention, the proportion "Gmax/Gmin" of the maximum width of the gap to the minimum width is 3.0 or less. At a proportion Gmax/Gmin of more than 3.0, the toner is unevenly filled in the gap region of the projecting part. If the upstream gap of the projecting part has a minimum width Gmin, the downstream gap has a maximum width Gmax, and the proportion Gmax/Gmin is more than 3.0, the toner readily moves in the gap region in the projecting part, and is not uniformly filled in the gap region. For this reason, the toner receives insufficient friction, and the toner having an excessively high charge quantity after developing of the solid white image is not removed from the surface of the developing roller. If the upstream gap of the projecting part has a maximum width Gmax, the downstream gap has a minimum width Gmin, and the proportion Gmax/Gmin is more than 3.0, a large amount of toner is taken into the upstream portion of the gap region, and is excessively tightly filled in the downstream portion of the gap region. The toner excessively tightly filled may push up the developer layer thickness controlling portion, causing poor regulation of the toner.

L2 is 0.8 mm or more, where L2 is a continuous length of the surface of the developing roller in the rotational direction of the developing roller in the gap satisfying the relationships represented by expressions (1) and (2). A length L2 of less than 0.8 mm results in an insufficient toner friction time in the toner removing region, and thus the toner having an excessively high charge quantity after developing of the solid white image is not removed from the surface of the developing roller. The length L2 can be 3.0 mm or less. At a length L2 of 3.0 mm or less, the toner tightly filled in the toner removing region will not push up the surface of the projecting part, suitably regulating the thickness of the toner layer in the developer layer thickness controlling portion.

The length L2 is a distance in the circumferential direction illustrated in FIG. 10, for example. In other words, the length L2 is a distance on the developing roller between two intersection points of two straight lines D and D and the surface of the developing roller, where the straight lines D and D connect two points on the surface of the projecting part 31*c* and the center of the cross-sectional circle of the developing roller.

In the developing apparatus according to the present invention, the projecting part of the developing blade facing the surface of the developing roller has an inwardly curved surface. A projecting part having an inwardly curved surface can provide a gap having a width G in the range of 0.05 mm or more and 0.5 mm or less to increase the length L2 of the gap region. Furthermore, the surface of the projecting part can have an inwardly curved shape. A projecting part having an inwardly curved surface can ensure a long and narrow gap in the rotational direction of the developing roller, therefore facilitating the friction of the toner and effectively removing the developer from the surface of the developing roller.

Furthermore, the developer layer thickness controlling portion can have a length (arc length) W of 1.0 mm or more and 5.0 mm or less. An increased frictional distance between the developing blade and the developing roller can provide a uniformly high amount of charges of the toner.

Modifications

Figure 4A:
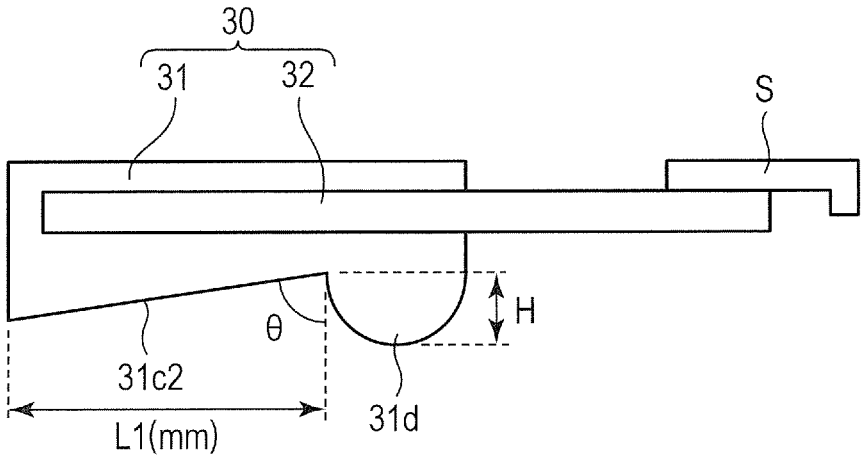
FIGS. 4A and 4B are diagrams illustrating a developing blade according to a modification of the present invention.
Figure 4B:
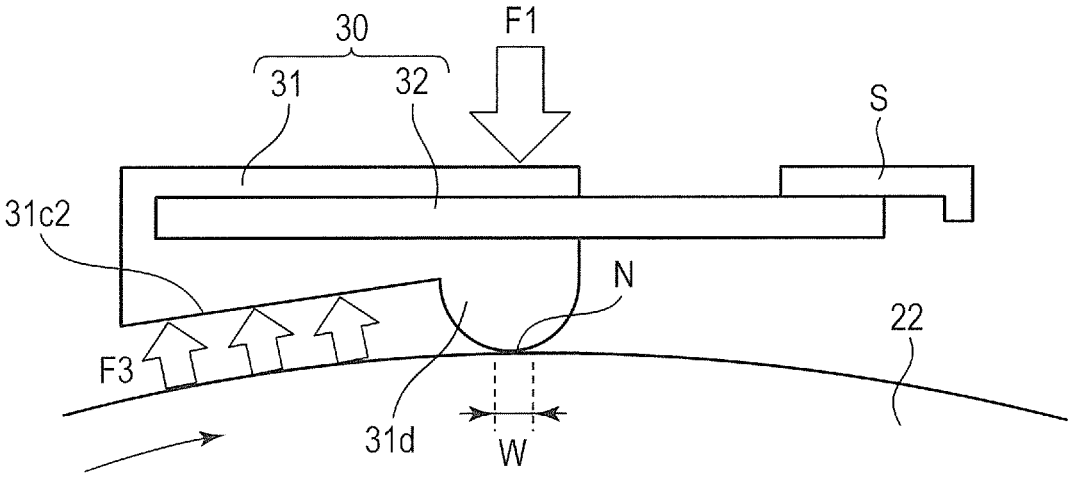

In the embodiment, as illustrated in FIGS. 1A and 1B, the blade part 31 has an opposing surface 31*c*1 having a curved surface having a curvature radius R and facing the developing roller 22 at a predetermined interval. The blade part, however, can have any other configuration. For example, as illustrated in FIGS. 4A and 4B as a modification of the present invention, the blade part 31 may have an opposing surface 31*c*1 facing the developing roller 22 at a predetermined interval and having an inclination to a plane in which the support part 32 extends. The blade part according to the modification has the same configuration as that of the embodiment except for the shape of the opposing surface 31*c*1, and the same referential numbers will be given to the same components, and their description will be omitted.

The developing blade 30 is formed such that the distal end of the support part 32 is covered with the blade part 31. As in the embodiment, the blade part 31 has the maximum height H (mm) of the projecting part 31*c*1 from the connection portion between an opposing surface 31*c*2 and the projecting part 31*d* in the direction orthogonal to the plane extending in the lateral direction of the support part 32, that is, the height of the projection of the projecting part 31*c*1.

As illustrated in FIG. 4B, in this modification, the opposing surface 31*c*2 has a flat surface inclined by an angle θ (°) to the normal direction of the developing roller 22 or an inclined surface in the abutting part (nip portion) N. In other words, the opposing surface 31*c*2 has an angle θ and a predetermined length L1, and as in the embodiment, the distance to the developing roller 22 is reduced from one end connected to the projecting part 31*d* to the other end disposed as a free end.

The toner is fed between the developing roller 22 and the opposing surface 31*c*2 as a result of rotation of the developing roller 22, and a pressure F3 from the toner is generated in the normal direction of the opposing surface 31*c*2. This configuration, however, partially converts the pressure F3 from the toner, which is a force applied in the direction orthogonal to the plane extending in the lateral direction of the support part 32 to deform the developing blade 30, to the force applied in the lateral direction of the support part 32. As a result, the force applied from the toner to the developing blade 30 can be dispersed, preventing the deformation of the developing blade 30 generated by the developing blade 30 pushed up in the direction away from the developing roller 22. As a result, an appropriate abutting pressure is applied between the developing blade 30 and the developing roller 22, providing a predetermined abutment width W. The inventors, who have conducted extensive research, have found that the angle q of the developing roller 22 inclined toward the upstream side of the rotational direction is more preferably 77° or less to the normal direction of the developing roller 22 in the abutting part (nip portion) N. An angle q controlled within this range can feed an appropriate amount of the toner between the opposing surface 31*c*2 and the developing roller 22, and simultaneously reduces the generation of the force contributing to the deformation of the developing blade 30.

In a region where the opposing surface 31*c*2 is formed in the developing blade 30 according to the present embodiment, the abutting part (nip portion) N has an increased thickness from one end connected to the projecting part 31*d* to the other end disposed as a free end in the normal direction of the developing roller 22. Such an increased thickness can ensure a sufficient abutment width W between the blade part 31 and the developing roller 22, and also keep predetermined positioning of the abutting part N independently of the abutting state, providing stable abutment of the blade part 31 with the developing roller 22.

The configuration described above suppresses a reduction in abutting pressure between the developing blade 30 and the developing roller 22 and reduces adhesion of the toner to the contact portion between the developing blade 30 and the developing roller 22. In the present embodiment, thus, poor regulation of the toner by the developing blade 30, and thus the generation of image defects can be reduced.

Also in the present embodiment, the opposing surface 31*c*2 has a length L1 controlled to be 0.85≤L1 (mm)≤2.00 where the length L1 is a length from the free end (distal end) of the blade part 31 to the level difference forming the projecting part 31*d*. The maximum height of the projecting part 31*c*1 from the connection portion between the opposing surface 31*c*2 and the projecting part 31*d* in the direction orthogonal to the plane extending in the lateral direction of the support part 32, that is, the height H of the projection of the projecting part 31*c*1 is controlled to be 0.1≤H (mm)≤0.3. Thus, the toner particles T1, T2 and T3 are better contacted with each other in the space defined between the developing roller 22 and the opposing surface 31*c*2; as a result, a uniform charge quantity (amount of charges) is given to the respective toner particles of the toner T, thus reducing the generation of image defects such as fogging.

Other Embodiments

In the projecting part of the developing blade, the surface facing the developing roller has an inwardly curved shape. Such an inwardly curved surface of the projecting part can ensure a gap having a narrow width satisfying the relationships represented by expressions (1) and (2) to the surface of the developing roller along a long distance in the rotational direction of the developing roller. The projecting part may have bent shapes and curve shapes. Curve shapes can be used. Since those curve shapes have no corners, the toner on the side of the surface of the projecting part can be smoothly circulated. Furthermore, the curve shape of the surface of the projecting part can be an arc shape of a circle concentric with a cross-sectional circle of the developing roller. In this case, a gap having a small width relative to the surface of the developing roller can be ensured over a long distance of the developing roller in the rotational direction. Examples of the shape of the projecting part include those illustrated in FIGS. 5 to 10.

As illustrated in FIG. 5, a level difference can be disposed in the boundary between a developer layer thickness controlling portion 31*a* and the projecting part 31*c*. A toner densely filled into the gap between the surface of the developing roller and the projecting part 31*c* may lift the surface of the projecting part upwards in some cases. The level difference can ensure the edge portion which controls the thickness of the toner layer, thus reducing the failure of control of the thickness of the toner layer.

Figure 8:
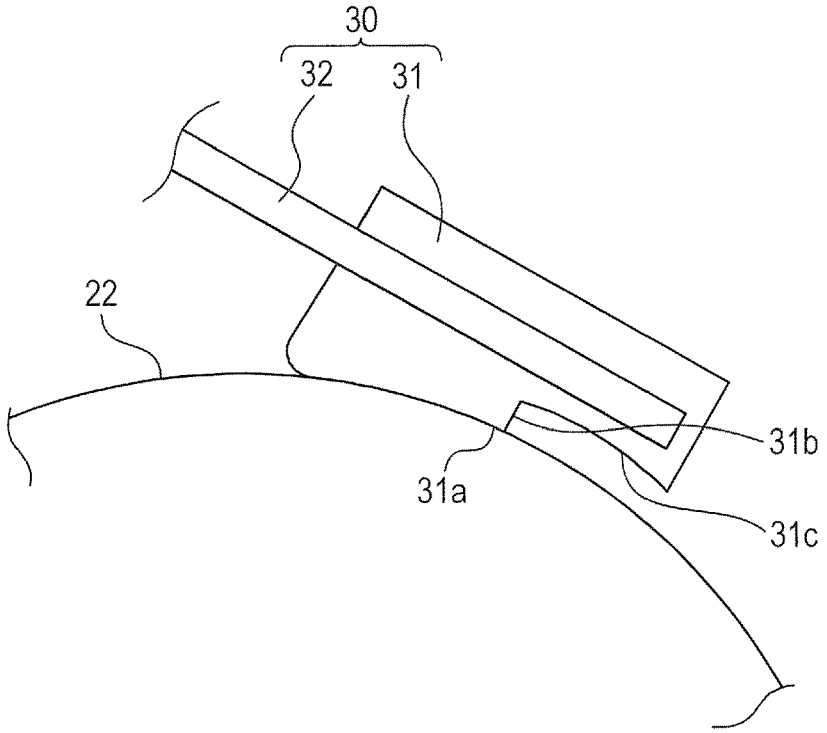
FIG. 8 is a schematic cross-sectional view illustrating another example of the developing blade according to the present invention.

The thickness of the toner layer is controlled and the toner is charged by friction between the developer layer thickness controlling portion and the surface of the developing roller. The developer layer thickness controlling portion may have any of a flat surface, a curve shape, a projected shape or a recessed shape. A curve shape is particularly preferred as illustrated in FIG. 8. A developer layer thickness controlling portion having a curve shape can increase the frictional distance by the developer layer thickness controlling portion and the developing roller to provide a uniformly high amount of charges of the toner. Furthermore, the developer layer thickness controlling portion can have a curve shape along the surface of the developing roller.

If the support part and the blade part are formed of different materials, the support part can be disposed to extend to the position of the projecting part. The support part extending to the position enhances the rigidity of the projecting part, and therefore can maintain a desired gap even if the toner is tightly filled in the gap between the surface of the developing roller and the surface of the projecting part.

The present invention will now be more specifically described by way of Production Examples and Examples. The term "distal end" of the projecting part of the developing blade refers to the end in the X-direction in FIG. 5, and the term "base" of the projecting part of the developing blade refers to the position at the boundary between the developer layer thickness controlling portion and the projecting part.

Example 2

1. Preparation of Developing Blade

A polyester thermoplastic resin (TPEE) (manufactured by Du Pont-Toray Co., Ltd.; trade name: Hytrel 4047N) was used as a material for a blade member. A support part used was formed of a SUS-304-1/2H material in the form of a long sheet having a length in the lateral direction of 15.2 mm and a thickness of 0.08 mm.

Figure 12:
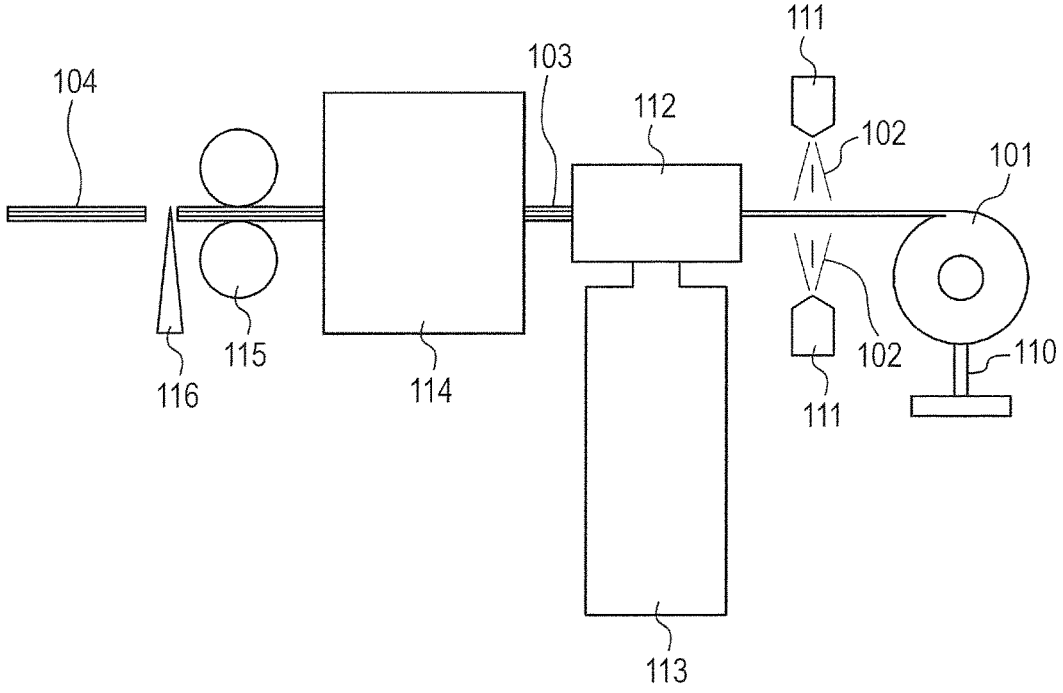
FIG. 12 illustrates one example of an apparatus for manufacturing a developing blade.

FIG. 12 is an apparatus for manufacturing a developing blade. A material for a blade part was first melted in an extrusion molding machine 113 at 200° C., and was injected into the molding cavity of a metal mold 112 for extrusion. At the same time, while a support part was traveling through the molding cavity of the metal mold for extrusion, one end surface of the support part in the lateral direction was coated with the material for a blade part. The temperature of the metal mold 112 was set at 250° C.

The blade part discharged from the metal mold 112 for extrusion was solidified by a cooler 114 to prepare a member having the support part having an abutting support surface, a distal end surface, and a surface opposite to the abutting support surface covered with the blade part. This member was cut into a length of 226 mm by a cutter 116 in the longitudinal direction, and then the surface facing the developing roller was processed to prepare developing blade No. 1 illustrated in FIG. 8 having a projecting part having a surface curvature radius R of 6.20 mm and a length $L_0$ of 1.0 mm.

2. Preparation of Developing Roller

A substrate was provided, which included a SUS304 shaft core having an outer diameter of 6 mm and a length of 270 mm and a primer (trade name: DY35-051; manufactured by Dow Corning Toray Co., Ltd.) applied and burned thereto. The substrate was disposed in a metal mold. An addition-type silicone rubber composition prepared through mixing the materials shown in Table 1 below was injected into the cavity defined in the metal mold.

TABLE 1

| Materials | Parts by mass |
|---|---|
| Liquid silicone rubber material (trade name: SE6724A/B, manufactured by Dow Corning Toray Co., Ltd.) | 100 |
| Carbon black (trade name: TOKABLACK #7360SB, manufactured by Tokai Carbon Co., Ltd.) | 20 |
| Platinum catalyst | 0.1 |

Subsequently, the silicone rubber composition was cured by heating the metal mold at a temperature of 150° C. for 15 minutes. The product was removed from the mold, and was further heated at a temperature of 180° C. for 1 hour to complete the curing reaction. A conductive elastic roller including a substrate and a conductive elastic layer having a thickness of 3 mm and disposed on the outer periphery of the substrate was prepared. Next, the materials shown in Table 2 below were weighed, and 100 parts by mass of methyl ethyl ketone was added. These materials were dispersed with a bead mill to prepare a surface layer coating solution.

TABLE 2

| Materials | Parts by mass |
|---|---|
| Polyol (trade name: N5120, manufactured by Nippon Polyurethane Industry Co., Ltd.) | 87 |
| Isocyanate (trade name: L-55E, manufactured by Nippon Polyurethane Industry Co., Ltd.) | 13 |
| Carbon black (trade name: MA77, manufactured by Mitsubishi Chemical Corporation) | 20 |
| Acrylic particle (trade name: G-800 Transparent, manufactured by Negami Chemical Industrial Co., Ltd.) | 50 |

Subsequently, the upper end of the substrate in the conductive elastic roller was held such that the longitudinal direction of the conductive elastic roller was aligned in the vertical direction. The conductive elastic roller was immersed in the surface layer coating solution, and was coated by dipping so as to have a film thickness of 10.0 μm. The immersion time was 9 seconds. The take-up rate of the workpiece from the coating solution was the initial take-up rate of 30 mm/s and the final take-up rate of 20 mm/s. The take-up rate between the initial take-up rate and the final take-up rate was linearly varied relative to the time. The workpiece was dried in an oven at a temperature of 80° C. for 15 minutes, and was heated in an oven at a temperature of 140° C. for 2 hours to perform a curing reaction. A surface layer was thereby formed to prepare developing roller No. 1 having a curvature radius DR of 6.0 mm.

3. Preparation of Developing Apparatus

Developing blade No. 1 and developing roller No. 1 were mounted on the developing apparatus illustrated in FIG. 5, and were set such that the maximum width Gmax and the minimum width Gmin of the gap were both 0.2 mm, the proportion Gmax/Gmin was 1.0, and the continuous length L2 of the gap satisfying expressions (1) and (2) in the rotational direction of the surface of the developing roller (hereinafter, referred to as "length L2 of removing region") was 1.0 mm.

4. Measurement of Shape of Gap Between Developing Blade and Developing Roller

FIG. 10 is a cross-sectional view of an abutting part between the developing blade and the developing roller seen in a direction perpendicular to the longitudinal direction of the developing blade. The view was magnified 500 times using a digital microscope (manufactured by Keyence Corporation; VHX-5000). The length L2 of a gap having a gap width G of 0.05 mm or more and 0.5 mm or less and a proportion Gmax/Gmin of 3.0 or less was measured on the surface of the developing roller. The measurement was performed at a pitch of 0.1 mm along the surface of the developing roller.

5. Evaluation of Ghost Using Electrophotographic Image Forming Apparatus

Developing roller No. 1 and developing blade No. 1 were integrated into a developing apparatus of a process cartridge for an electrophotographic image forming apparatus (trade name: CLJ CP4525, manufactured by Hewlett-Packard Company). The electrophotographic image forming apparatus was left under a low temperature and low humidity environment at a temperature of 15° C. and a relative humidity of 10% for 24 hours. Next, an image for evaluation was printed to evaluate developing ghost.

The determination of developing ghost was performed using an image for evaluation in which a solid black patch of 5 mm×5 mm was printed at an interval of 10 mm in the leading end of a sheet, and a halftone image was then printed. In this image, the density of the halftone image in a pitch of the developing roller after printing of the solid black patch and the density of the halftone image in another portion were measured using a Spectordensitometer 500 manufactured by X-Rite, Incorporated. The printed images were ranked from the difference in the density of the halftone image according to the following criteria:

A: The difference in the density of the halftone image is less than 0.04.

B: The difference in the density of the halftone image is 0.04 or more and less than 0.08.

C: The difference in the density of the halftone image is 0.08 or more.

Examples 3 and 4

Developing blade No. 2 was prepared in the same manner as in Example 2 except that the curvature radius R of the surface of the projecting part facing the developing roller was 6.05 mm (Example 2) or 6.50 mm (Example 3), and the length $L_0$ of the projecting part was 1.0 mm. The maximum width Gmax and the minimum width Gmin of the gap, the proportion Gmax/Gmin, and the length L2 of the developer removing region were set so as to form a gap shown in Table 4. Except for these, developing apparatuses were prepared, measured and evaluated in the same manner as in Example 2.

Example 5

Figure 6:
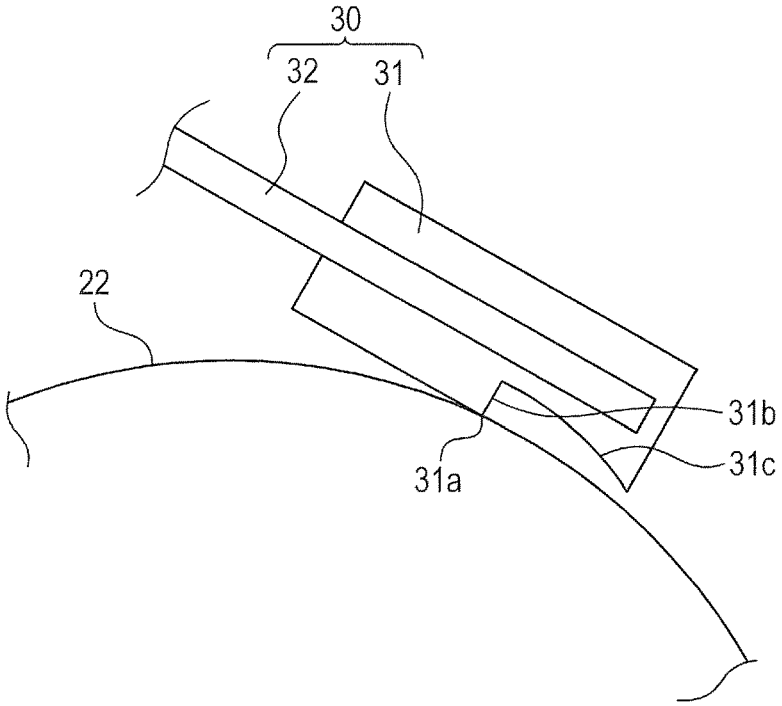
FIG. 6 is a schematic cross-sectional view illustrating another example of the developing blade according to the present invention.

As illustrated in FIG. 6, developing blade No. 4 was prepared in the same manner as in Example 2 except that a gap was formed such that the minimum width Gmin was 0.10 mm at the distal end of the projecting part, the maximum width Gmax was 0.20 mm at the base of the projecting part, and the proportion Gmax/Gmin was 2.0. Furthermore, a developing apparatus was prepared, measured and evaluated.

Example 6

Figure 7:
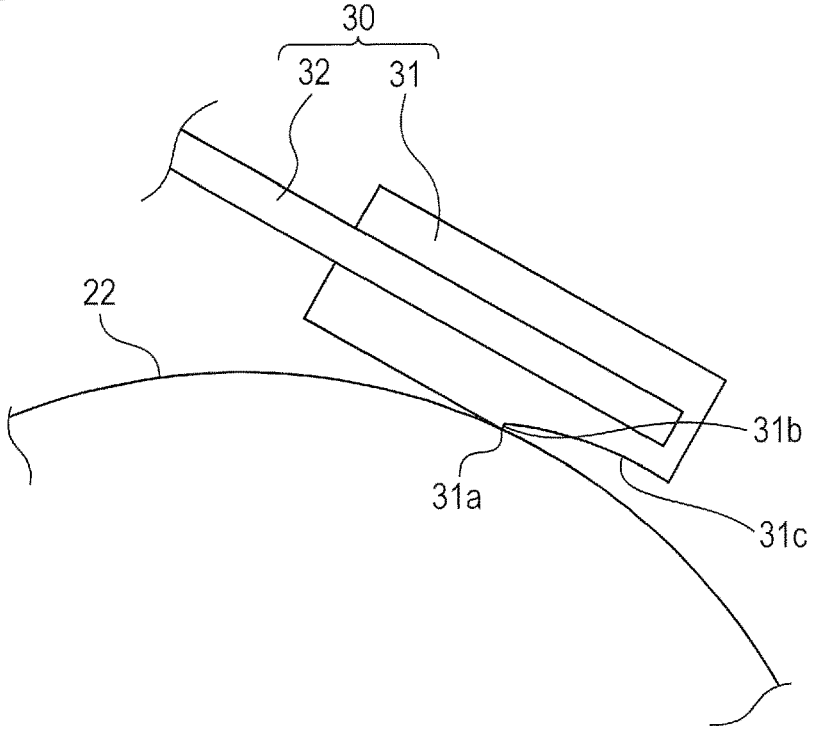
FIG. 7 is a schematic cross-sectional view illustrating a reference example of the developing blade according to the present invention.

As illustrated in FIG. 7, developing blade No. 5 was prepared in the same manner as in Example 2 except that a gap was formed such that the maximum width Gmax was 0.20 mm at the distal end of the projecting part, the minimum width Gmin was 0.10 mm at the base of the projecting part, and the proportion Gmax/Gmin was 2.0. Furthermore, a developing apparatus was prepared, measured and evaluated.

Example 7

A developing apparatus was prepared in the same manner as in Example 4 except that a gap was formed such that Gmax, Gmin, and the proportion Gmax/Gmin were as shown in Table 4. The developing apparatus was measured and evaluated in the same manner as in Example 4.

Example 8

A developing apparatus was prepared in the same manner as in Example 5 except that a gap was formed such that Gmax, Gmin, and the proportion Gmax/Gmin were as shown in Table 4. The developing apparatus was measured and evaluated in the same manner as in Example 5.

Examples 9 to 11

Developing blades Nos. 8 to 10 were prepared in the same manner as in Example 2 except that in the developing blade, the curvature radius R of the surface of the projecting part facing the developing roller was 6.20 mm, and the length $L_0$ of the projecting part was 0.8 mm (Example 8), 3.0 mm (Example 9) or 2.0 mm (Example 10). The length L2 of the developer removing region was set at 0.8 mm. Except for theses, a developing apparatus was prepared, measured and evaluated in the same manner as in Example 2.

Example 12

Figure 9A:
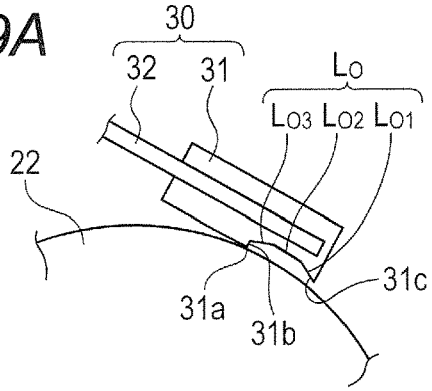
FIGS. 9A, 9B and 9C are schematic cross-sectional views illustrating another example of the developing blade according to the present invention.

As illustrated in FIG. 9A, as the developing blade 30, developing blade No. 11 was prepared in which the surface of the projecting part 31*c* facing the developing roller had a bent shape, and the length $L_0$ of the projecting part was divided into three lengths, a length $L_{01}$ of the projecting part in the distal end, a length $L_{02}$ in the central projecting part, and a length $L_{03}$ of the projecting part at the base. The angle formed by $L_{01}$ and $L_{02}$ and the angle formed by $L_{02}$ and $L_{03}$ facing the surface of the projecting part were 170°. Except for these, a developing apparatus was prepared, measured and evaluated in the same manner as in Example 2.

Example 13

Developing blade No. 12 was prepared in the same manner as in Example 2 except that the curvature radius R of the surface of the projecting part facing the developing roller was 6.30 mm, and the length $L_0$ of the projecting part was 1.0 mm. Gmax was set at 0.30 mm, and Gmin was set at 0.30 mm. Except for these, a developing apparatus was prepared, measured and evaluated in the same manner as in Example 2.

Example 14

Developing blade No. 13 was prepared in the same manner as in Example 4 except that the curvature radius R of the surface of the projecting part facing the developing roller was 6.30 mm, the length $L_0$ of the projecting part was 1.0 mm, and as illustrated in FIG. 6, a gap was formed to have a Gmin of 0.10 mm at the distal end of the projecting part, a Gmax of 0.30 mm in the projecting part facing the developer layer thickness controlling portion, and a proportion Gmax/Gmin of 3.0. In the next step, a developing apparatus was prepared, measured and evaluated in the same manner as in Example 2.

Example 15

Developing blade No. 14 was prepared in the same manner as in Example 5 except that the curvature radius R of the surface of the projecting part facing the developing roller was 6.30 mm, the length $L_0$ of the projecting part was 1.0 mm, and as illustrated in FIG. 7, a gap was formed to have a Gmax of 0.30 mm at the distal end of the projecting part, a Gmin of 0.10 mm in the projecting part facing the developer layer thickness controlling portion, and a proportion Gmax/Gmin of 3.0. In the next step, except for these, a developing apparatus was prepared, measured and evaluated in the same manner as in Example 2.

Examples 16 to 18

Developing blades No. 15 to 17 were prepared in the same manner as in Example 2 except that the length W of the developer layer thickness controlling portion was 1.0 mm (Example 15), 3.0 mm (Example 16) or 5.0 mm (Example 17). In the next step, developing apparatuses were prepared, measured and evaluated in the same manner as in Example 2.

Example 19

A developing apparatus was prepared in the same manner as in Example 2 except that the curvature radius R of the surface of the projecting part facing the developing roller was 6.20 mm, and the length $L_0$ of the projecting part was 4.0 mm. The developing apparatus was measured and evaluated in the same manner as in Example 2.

Example 20

Figure 9B:
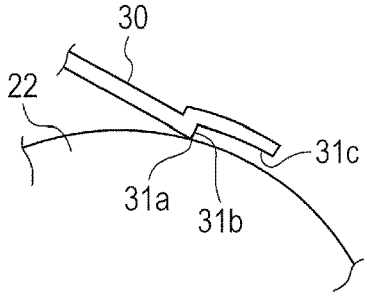

This Example is an exemplary developing blade illustrated in FIG. 9B in which the support part and the blade part are formed of the same material.

1. Preparation of Developing Blade

Two materials shown in Component (1) of Table 3 below were reacted under stirring at a temperature of 80° C. for 3 hours to prepare a prepolymer (NCO %: 8.50%). Five materials shown in Component (2) of Table 3 were mixed with the prepolymer to prepare a polyurethane elastomer raw material composition. This composition was injected into the cavity of a metal mold for molding, and was cured at a temperature of 130° C. over 2 minutes; the workpiece was removed from the metal mold to prepare an elastic member. This elastic member was cut into a size of 226 mm in the longitudinal direction, 15.2 mm in the lateral direction, and a thickness of 2.0 mm. In the next step, the elastic member was further processed to prepare developing blade No. 19 illustrated in FIG. 9B in which the surface of the projecting part 31*c* facing the developing roller had a curvature radius R of 6.20 mm, and the projecting part had a length $L_0$ of 1.0 mm.

TABLE 3

| | Abbreviations | Materials | Amount used g |
|---|---|---|---|
| Components (1) | MDI | 4,4'-Diphenylmethane diisocyanate (trade name; Millionate MT, manufactured by Tosoh Corporation) | 326.3 |
| | PBA | Polybutylene adipate polyester polyol having number average molecular weight of 2500 | 673.7 |

TABLE 3-continued

| | Abbreviations | Materials | Amount used g |
|---|---|---|---|
| Components (2) | PHA | Polyhexylene adipate polyester polyol having number average molecular weight of 1000 | 150.8 |
| | 14BD | 1,4-Butanediol | 26.2 |
| | TMP | Trimethylolpropane | 21.4 |
| | Catalyst A | Polycat46 (trade name, available from Air Products Japan K. K.) | 0.07 |
| | Catalyst B | N,N-dimethylaminohexanol (trade name; KAOLIZER No. 25, manufactured by Kao Corporation) | 0.28 |

2. Preparation and Evaluation of Developing Apparatus

A developing apparatus was prepared in the same manner as in Example 2 except that the developing blade was used. The measurement and the evaluation were performed in the same manner as in Example 2.

Example 21

Figure 9C:
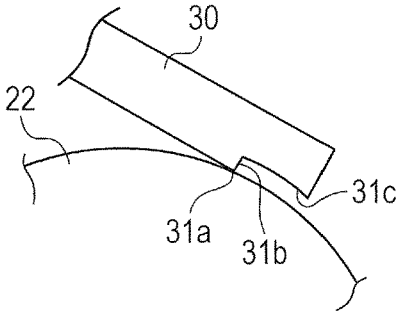

As illustrated in FIG. 9C, a developing blade was used which included a support part and a blade part formed of the same material. Developing blade No. 20 was prepared by pressing a SUS-304-1/2H material into a size of 15.2 mm in the lateral direction, 226 mm in the longitudinal direction, and a thickness of 0.08 mm. Except for these, a developing roller and a developing blade were incorporated into a developing apparatus in the same manner as in Example 2. The measurement and the evaluation were performed in the same manner as in Example 2.

The configurations of the members, the measured values, and the results of evaluation in the Examples are shown in Table 4.

Comparative Example 1

Developing blade No. 21 was prepared in which the surface of the projecting part facing the developing roller had a linear shape, and a gap was formed so as to have a minimum width Gmin of 0.20 mm in the central portion of the surface of the projecting part. A developing roller and a developing blade were incorporated into a developing apparatus in the same manner as in Example 2. The measurement and the evaluation were performed in the same manner as in Example 2.

Comparative Example 2

A developing blade was set such that the curvature radius R was 6.03 mm, and a gap was formed so as to have a maximum width Gmax and a minimum width Gmin of 0.03 mm. Except for these, a developing apparatus was prepared in the same manner as in Example 2, and the measurement and the evaluation were performed in the same manner as in Example 2.

Comparative Example 3

A developing blade was set such that the curvature radius R was 6.60 mm, and a gap was formed so as to have a maximum width Gmax and a minimum width Gmin of 0.6 mm. Except for these, a developing apparatus was prepared in the same manner as in Example 2, and the measurement and the evaluation were performed in the same manner as in Example 2.

Comparative Example 4

A developing blade was set such that the length $L_0$ of the projecting part was 0.5 mm, and a gap was formed so as to have a length L of the toner removing region of 0.5 mm. Except for these, a developing apparatus was prepared in the same manner as in Example 2, and the measurement and the evaluation were performed in the same manner as in Example 2.

Comparative Example 5

A developing apparatus was prepared in the same manner as in Example 2 except that as illustrated in FIG. 6, a gap was formed so as to have a minimum width Gmin of 0.05 mm at the distal end of the projecting part, a maximum width Gmax of 0.20 mm at the base of the projecting part, and a proportion Gmax/Gmin of 4.0. The measurement and the evaluation were performed in the same manner as in Example 2.

Comparative Example 6

A developing apparatus was prepared in the same manner as in Example 2 except that as illustrated in FIG. 7, a gap was formed so as to have a maximum width Gmax of 0.20 mm at the distal end of the projecting part, a minimum distance Gmin of 0.05 mm at the base of the projecting part, and a proportion Gmax/Gmin of 4.0. The measurement and the evaluation were performed in the same manner as in Example 2.

The configurations of the members, the measured values, and the results of evaluation in the Comparative Examples are shown in Table 5.

TABLE 4

| Example | Developing blade No. | Shape of surface of projecting part | Material for blade member | Length L of removing region mm | Length W of layer thickness controlling portion mm | Curvature radius R of surface of projecting part mm | Radius DR of developer carrying roller mm |
|---|---|---|---|---|---|---|---|
| 2 | 1 | Curved | TPEE | 1.0 | 0.5 | 6.20 | 6.0 |
| 3 | 2 | Curved | TPEE | 1.0 | 0.5 | 6.05 | 6.0 |
| 4 | 3 | Curved | TPEE | 1.0 | 0.5 | 6.50 | 6.0 |

TABLE 4-continued

| | | | | | | | |
|---|---|---|---|---|---|---|---|
| 5 | 4 | Curved | TPEE | 1.0 | 0.5 | 6.20 | 6.0 |
| 6 | 5 | Curved | TPEE | 1.0 | 0.5 | 6.20 | 6.0 |
| 7 | 6 | Curved | TPEE | 1.0 | 0.5 | 6.20 | 6.0 |
| 8 | 7 | Curved | TPEE | 1.0 | 0.5 | 6.20 | 6.0 |
| 9 | 8 | Curved | TPEE | 0.8 | 0.5 | 6.20 | 6.0 |
| 10 | 9 | Curved | TPEE | 3.0 | 0.5 | 6.20 | 6.0 |
| 11 | 10 | Curved | TPEE | 2.0 | 0.5 | 6.20 | 6.0 |
| 12 | 11 | Bent | TPEE | 1.0 | 0.5 | — | 6.0 |
| 13 | 12 | Curved | TPEE | 1.0 | 0.5 | 6.30 | 6.0 |
| 14 | 13 | Curved | TPEE | 1.0 | 0.5 | 6.30 | 6.0 |
| 15 | 14 | Curved | TPEE | 1.0 | 0.5 | 6.30 | 6.0 |
| 16 | 15 | Curved | TPEE | 1.0 | 1.0 | 6.20 | 6.0 |
| 17 | 16 | Curved | TPEE | 1.0 | 3.0 | 6.20 | 6.0 |
| 18 | 17 | Curved | TPEE | 1.0 | 5.0 | 6.20 | 6.0 |
| 19 | 18 | Curved | TPEE | 4.0 | 0.5 | 6.20 | 6.0 |
| 20 | 19 | Curved | Thermosetting polyurethane | 1.0 | 0.5 | 6.20 | 6.0 |
| 21 | 20 | Curved | SUS | 1.0 | 0.5 | 6.2 | 6.0 |

| | Gap width H | | | | | | |
|---|---|---|---|---|---|---|---|
| Example | Distal end mm | Center mm | Base mm | Maximum Hmax mm | Minimum Hmin mm | Proportion Hmax/Hmin — | Evaluation of ghost images |
| 2 | 0.20 | 0.20 | 0.20 | 0.20 | 0.20 | 1.0 | A |
| 3 | 0.05 | 0.05 | 0.05 | 0.05 | 0.05 | 1.0 | A |
| 4 | 0.50 | 0.50 | 0.50 | 0.50 | 0.50 | 1.0 | B |
| 5 | 0.10 | 0.15 | 0.20 | 0.20 | 0.10 | 2.0 | A |
| 6 | 0.20 | 0.15 | 0.10 | 0.20 | 0.10 | 2.0 | A |
| 7 | 0.07 | 0.14 | 0.21 | 0.21 | 0.07 | 3.0 | B |
| 8 | 0.21 | 0.14 | 0.07 | 0.60 | 0.21 | 3.0 | B |
| 9 | 0.20 | 0.20 | 0.20 | 0.20 | 0.20 | 1.0 | A |
| 10 | 0.20 | 0.20 | 0.20 | 0.20 | 0.20 | 1.0 | A |
| 11 | 0.20 | 0.20 | 0.20 | 0.20 | 0.20 | 1.0 | A |
| 12 | 0.18 | 0.22 | 0.18 | 0.22 | 0.18 | 1.2 | B |
| 13 | 0.30 | 0.30 | 0.30 | 0.30 | 0.30 | 1.0 | A |
| 14 | 0.10 | 0.20 | 0.30 | 0.30 | 0.10 | 3.0 | A |
| 15 | 0.30 | 0.20 | 0.10 | 0.30 | 0.10 | 3.0 | A |
| 16 | 0.20 | 0.20 | 0.20 | 0.20 | 0.20 | 1.0 | A |
| 17 | 0.20 | 0.20 | 0.20 | 0.20 | 0.20 | 1.0 | A |
| 18 | 0.20 | 0.20 | 0.20 | 0.20 | 0.20 | 1.0 | A |
| 19 | 0.20 | 0.20 | 0.20 | 0.20 | 0.20 | 1.0 | B |
| 20 | 0.20 | 0.20 | 0.20 | 0.20 | 0.20 | 1.0 | B |
| 21 | 0.20 | 0.20 | 0.20 | 0.20 | 0.20 | 1.0 | B |

TABLE 5

| Comparative Example | Developing blade No. | Shape of surface of projecting part | Material for blade member | Length L of removing region mm | Length W of layer thickness controlling portion mm | Curvature radius R of surface of projecting part mm | Radius DR of developer carrying roller mm |
|---|---|---|---|---|---|---|---|
| 1 | 21 | Linear | TPEE | 1.0 | 0.5 | — | 6.0 |
| 2 | 22 | Curved | TPEE | 1.0 | 0.5 | 6.03 | 6.0 |
| 3 | 23 | Curved | TPEE | 1.0 | 0.5 | 6.60 | 6.0 |
| 4 | 24 | Curved | TPEE | 0.5 | 0.5 | 6.20 | 6.0 |
| 5 | 25 | Curved | TPEE | 1.0 | 0.5 | 6.20 | 6.0 |
| 6 | 26 | Curved | TPEE | 1.0 | 0.5 | 6.20 | 6.0 |

| | Gap width H | | | | | | |
|---|---|---|---|---|---|---|---|
| Comparative Example | Distal end mm | Center mm | Base mm | Maximum Hmax mm | Minimum Hmin mm | Proportion Hmax/Hmin — | Evaluation of ghost images |
| 1 | 0.22 | 0.20 | 0.22 | 0.22 | 0.20 | 1.1 | C |
| 2 | 0.03 | 0.03 | 0.03 | 0.03 | 0.03 | 1.0 | C |
| 3 | 0.60 | 0.60 | 0.60 | 0.60 | 0.60 | 1.0 | C |
| 4 | 0.20 | 0.20 | 0.20 | 0.20 | 0.20 | 1.0 | C |
| 5 | 0.05 | 0.13 | 0.20 | 0.20 | 0.05 | 4.0 | C |
| 6 | 0.20 | 0.13 | 0.05 | 0.20 | 0.05 | 4.0 | C |

As described above, the developing apparatus according to the present invention can reduce the generation of ghost images because the developing roller and the projecting part of the developing blade facing the developing roller have an inwardly curved surface, and the toner removing region satisfying all of the relationships represented by expressions (1), (2) and (3) is disposed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-150121, filed Jul. 29, 2016, and Japanese Patent Application No. 2016-197323, filed Oct. 5, 2016 which are hereby incorporated by reference herein in their entirety.

What is claimed is:

1. A developing apparatus, comprising:

a developer carrying member configured to carry a developer on a surface thereof, a developing frame member configured to rotatably support the developer carrying member, and configured to accommodate the developer, and a regulating member, provided on the developing frame member and configured to regulate the developer carried on the developer carrying member, wherein the regulating member comprises:

a projecting part projected towards the developer carrying member and having an abutting part that abuts the developer carrying member, and an opposing surface, facing the developer carrying member, the opposing surface being positioned on an upstream side of the projecting part in the rotational direction of the developer carrying member and being arranged to connect the projecting part with a distal end of the regulating member at a free end side of the regulating member, and wherein the opposing surface is a surface having no point of reverse curve, and the distance between the opposing surface and the developer carrying member being constant or decreasing with distance from the projecting part.

2. The developing apparatus according to claim 1, wherein, the opposing surface has a curvature radius R in the range represented by an expression $R=X\pm0.5X$ (mm), where the developer carrying member has a radius X.

3. The developing apparatus according to claim 1, wherein, in the region in which the opposing surface is formed, the thickness of the regulating member in a normal direction of the developer carrying member in the abutting part is increased with distance from the projecting part.

4. The developing apparatus according to claim 1, wherein, the opposing surface is planar and has an angle of incline away from a normal to the developer carrying member in the normal direction of the developer carrying member, the angle of incline being 77° or less.

5. The developing apparatus according to claim 1, wherein, the developer carrying member includes a blade part having the projecting part and the opposing surface, and a support part fixed to the developing frame member and arranged to support the blade part.

6. The developing apparatus according to claim 1, wherein the developer is a non-magnetic one-component toner.

7. The developing apparatus according to claim 1, wherein the opposing surface has a length L of $0.85\leq L$ (mm)$\leq2.00$, where L is a length from the distal end of the regulating member to the base of the projecting part, and the projecting part has a maximum height H of $0.1\leq H$ (mm)$\leq0.3$.

8. A process cartridge, comprising:

an image bearing member having a surface on which an electrostatic latent image is formed, and a developing apparatus which is arranged to develop the electrostatic latent image on the image bearing member with a developer carried on a developer carrying member, wherein the developing apparatus comprises a developer carrying member configured to carry a developer on a surface thereof, a developing frame member configured to rotatably support the developer carrying member, and configured to accommodate the developer, and a regulating member, provided on the developing frame member and configured to regulate the developer carried on the developer carrying member, wherein the regulating member comprises:

a projecting part projected towards the developer carrying member and having an abutting part that abuts the developer carrying member, and an opposing surface, facing the developer carrying member, the opposing surface being positioned on an upstream side of the projecting part in the rotational direction of the developer carrying member and being arranged to connect the projecting part with a distal end of the regulating member at a free end side of the regulating member, and wherein the opposing surface being a surface having no point of reverse curve, and the distance between the opposing surface and the developer carrying member being constant or decreasing with distance from the projecting part.

* * * * *